US008458830B1

(12) United States Patent
Pierce et al.

(10) Patent No.: US 8,458,830 B1
(45) Date of Patent: Jun. 11, 2013

(54) SLEEP MAT WITH ENCOMPASSING CUSHION

(76) Inventors: Shelley Ann Pierce, Hendersonville, NC (US); Skip Pierce, Hendersonville, NC (US)

( * ) Notice: Subject to any disclaimer, the term of this patent is extended or adjusted under 35 U.S.C. 154(b) by 0 days.

(21) Appl. No.: 13/199,374

(22) Filed: Aug. 29, 2011

(51) Int. Cl.
*A47G 9/02* (2006.01)
*A41B 13/06* (2006.01)

(52) U.S. Cl.
USPC ..... 5/413 R; 5/632; 5/731

(58) Field of Classification Search
USPC ..... 5/413 R, 417, 419, 420, 655, 657, 5/731–734, 630, 632
See application file for complete search history.

(56) References Cited

U.S. PATENT DOCUMENTS

| | | | | |
|---|---|---|---|---|
| 2,626,407 | A | 1/1953 | Kurry | |
| 2,629,884 | A | 3/1953 | McMonagle | |
| 2,644,173 | A | 7/1953 | James | |
| 3,400,413 | A | 9/1968 | Grossa | |
| 3,408,107 | A * | 10/1968 | Savage | 297/452.41 |
| 3,583,765 | A * | 6/1971 | Wallis | 5/655 |
| 3,803,646 | A | 4/1974 | Newerowski | |
| 4,173,048 | A | 11/1979 | Varaney | |
| 4,873,734 | A | 10/1989 | Pollard | |
| D309,200 | S | 7/1990 | McMahon | |
| 5,165,130 | A | 11/1992 | Wendling | |
| D342,855 | S | 1/1994 | Butler, II | |
| 5,351,348 | A | 10/1994 | Beger | |
| D353,494 | S | 12/1994 | Beger | |
| D357,589 | S | 4/1995 | Langhammer et al. | |
| D366,368 | S | 1/1996 | McCarthy | |
| 5,551,108 | A | 9/1996 | Butler, III | |
| 5,561,876 | A | 10/1996 | Petruzella | |
| D393,772 | S | 4/1998 | Vingino | |
| D415,919 | S | 11/1999 | Porter | |
| D416,159 | S | 11/1999 | Porter | |
| 6,848,128 | B2 | 2/2005 | Verbovszky et al. | |
| 7,059,000 | B2 | 6/2006 | Verbovszky | |
| 7,513,001 | B1 * | 4/2009 | Leach | 5/655 |
| 7,676,871 | B1 * | 3/2010 | Leach | 5/655 |
| 7,818,842 | B2 | 10/2010 | Marciano | |
| 7,856,688 | B2 | 12/2010 | Dockendorf | |
| 8,074,310 | B1 * | 12/2011 | Robbins | 5/632 |
| 2004/0255379 | A1 * | 12/2004 | Zheng | 5/413 AM |
| 2005/0125902 | A1 * | 6/2005 | Matthews Brown et al. | 5/655 |
| 2008/0120774 | A1 * | 5/2008 | Hite | 5/494 |

* cited by examiner

*Primary Examiner* — Robert G Santos
*Assistant Examiner* — Richard G Davis
(74) *Attorney, Agent, or Firm* — Monahan & Company; Timothy J. Monahan

(57) ABSTRACT

A body enveloping sleeping device has a generally pear shaped body member that has a mat, cushioned or uncushioned, that is encompassed by a cushion about the mat's outer periphery with a pocket formed between the mat and the cushion on an interior area of the device. A scalloped pillow is located atop the cushion at the cushion's wide end. At least one side opening is located in the body member for allowing the user's arms to pass therethrough. A blanket is attached, fixedly or removably, to the body member.

18 Claims, 7 Drawing Sheets

SLEEP MAT WITH ENCOMPASSING CUSHION

BACKGROUND OF THE INVENTION

1. Field of the Invention

The present invention relates to a soft sleep mat that has a cushion encompassing the mat about the outer periphery so that the sleep mat envelopes the body of the user and provides an inner pocket formed between the mat and cushion.

2. Background of the Prior Art

Getting kids to sleep at night and at nap time can be a challenge. While some kids will sleep anywhere and at any time under most conditions, other kids will resist the urge and the need to sleep. As most parents know, a child who does not sleep properly, can be quite the handful. Caregivers have learned a few tricks to help induce a child to sleep at nap time as well as at night. Keeping the child comfortable, keeping the child snug and secure, and making the sleep environment a fun one, all contribute greatly to helping get the child to slumber.

For many kids, being in their own bed, which is comfortable and familiar, goes a long way to achieving these slumber assist goals. However, often additional help is needed, such as when the child is traveling and is not in necessarily familiar surroundings or simply when the caregiver wants the child closer to the caregiver than the comfort of the child's room. At these times additional sleep ammunition can be of great help.

A device is needed that helps caregivers achieve the above goals in order to increase the possibility of achieving quality rest by a child using the device. Such a device must be very comfortable to the child not only in its overall support function, but must also keep the child comfortable with respect to temperature. Such a device must be snug to give the child a sense of safety and security which is especially essential to younger children, but is also important to older kids, especially when the child is in unfamiliar surroundings or when there is stormy weather outside. A child that is snug and has a sense of security is more apt to achieve a longer and more satisfying rest period. Such a device should present the child with a fun resting environment in order to draw the child to the device. Ideally, such a device must be of relatively simple design and construction so as to be able to be produced using standard manufacturing techniques so as to be readily affordable to potential consumers of such devices.

Furthermore, such a device should have additional benefits including being able to add comfort to kids and adults when engaged in other activities, such as sitting around a camp fire, sitting in a tree stand, sitting on a sofa on a cold winter night, etc.

SUMMARY OF THE INVENTION

The sleep mat with encompassing cushion of the present invention addresses the aforementioned needs in the art by providing a mat suitable for resting such that the mat is comfortable both in its support function as well as its ability to keep a child (as well as an adult) warm and snug. The sleep mat with encompassing cushion envelops the child therein in order to give the user a snug and secure feeling increasing the user's overall comfort within the device. The sleep mat with encompassing cushion can be decorated in various designs in order to be fun and whimsical thereby increasing the child's attraction to the device. The sleep mat with encompassing cushion is of relatively simple design and construction so as to be readily simple to produce using standard manufacturing techniques. The sleep mat with encompassing cushion can be produced in a variety of sizes in order to accommodate users of various sizes from infant all the way up to adults. The sleep mat with encompassing cushion also functions as a cushion proper in that it can be used for comfort during activities other than sleeping. A small example of such additional activities include sitting around a camp fire, sitting in a tree stand, or simply sitting on the living room sofa watching television during a cold night. In each of these situations, as well as a myriad of others, the present invention can be used as a cushion aid for sitting on and/or to bundle up in blanket fashion in order to keep the user or users warm and comfortable.

The sleep mat with encompassing cushion is comprised of a generally pear- or teardrop-shaped body member that has a relatively narrow first end and a relatively wide second end. The body member has a mat, cushioned or uncushioned, with an upper surface, a lower surface, and an outer periphery. A cushion extends upwardly from the upper surface and encompasses the outer periphery of the mat such that a pocket is formed between the mat and the cushion along the interior length of the cushion. The pocket is used to snugly receive the user's feet at the narrow end, the user's hands and upper arms at the wide end, or entire portions of the user's body along one or both sides of the device. A scalloped pillow is attached to the cushion proximate the wide second end. At least one opening passes through a side of the body member between the first end and the second end at approximately arm height of a user properly held within the device. A blanket is attached, removably or otherwise, to the body member.

BRIEF DESCRIPTION OF THE DRAWINGS

Similar reference numerals refer to similar parts throughout the several views of the drawings.

DESCRIPTION OF THE PREFERRED EMBODIMENT

Figure 1:
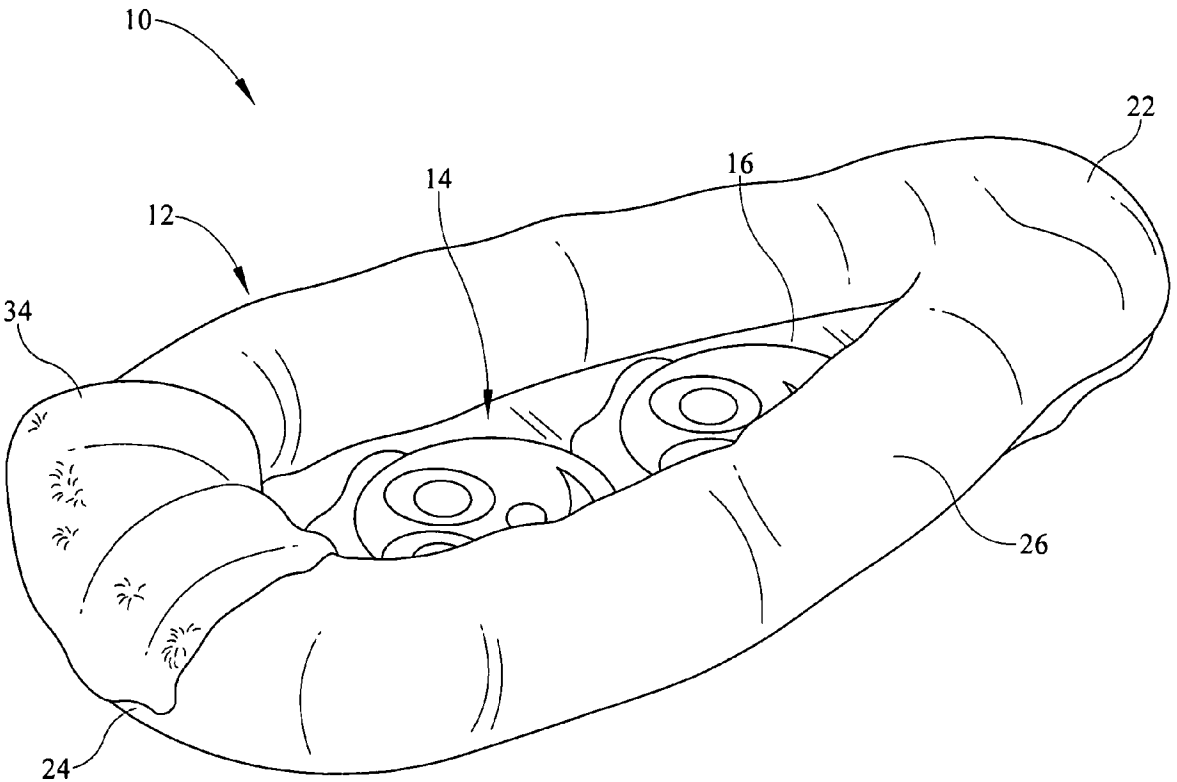
FIG. 1 is a perspective view of the sleep mat with encompassing cushion of the present invention.

Referring now to the drawings, it is seen that the sleep mat with encompassing cushion of the present invention, generally denoted by reference numeral 10, is comprised of a body member 12 that has a relatively flat mat 14 that is cushioned and that has an upper surface 16 and a lower surface 18 and an outer periphery 20. The mat 14 is generally pear shaped and has a lower relatively narrow end 22 and an upper relatively wide end 24. As seen, the upper surface 16 can be decorated as desired. The mat 14 is a typical mat configuration such that appropriate cushioning material (foam, memory foam, latex, etc.,) is held within the mat 14 and bounded by upper and lower layers, which can be made from an appropriate cloth or similar material which may have water impervious qualities, either due to the properties of the bounding upper and lower layers or may be a separate water impervious layer (not illustrated) that is attached to the upper layer or the lower layer or both in order to prevent moisture from penetrating to the internal cushioning within the mat 14 either from the child C (directly or via a spilled drink) or from the environment such as if the mat 14 is set upon a moist ground surface. Alternately, the mat 14 may be non-cushioned.

Located along the outer periphery 20 and encompassing the mat 14 is a cushion 26 that encompasses the entire mat 14 and extends upwardly from the upper surface 14. The cushion 26 is a typical cushion having cushioning material (may be the same material as used to cushion the mat 14) secured by a covering layer which may be water impervious or have an additional layer to that effect. A recess or pocket 28 is formed between the mat 14 and the cushion 26 along the interior length of the cushion 26. The pocket 28 is sized to be able to receive the user's feet F at the narrow end 22 of the body member 12, the user's arms A (especially the upper arms) and hands within the pocket 28 at the wide end 24, and the side of the user's body (arm, leg, torso, or combination) along one or both sides of the body member 12. Basically, the pocket 28 adds an extra level of snugness to the user C. Inwardly facing portions of the cushion 26 can be attached (stitching, cooperating hook and loop material, etc.,) to one another to help expand this pocket 28. An opening 30 is located in the side of the device 10 between the mat 14 and the cushion 26 which opening allows the child's arm A to pass therethrough for side sleepers, the opening 30 can be on either or both sides of the device 10. A similar second opening (not separately illustrated) may be located on the opposing side of the device 10. One or more pockets 32 can be located on the mat 14 or on the cushion 26 or both for holding various sundry items, such as a remote control, a phone, candy, etc. A pillow 34 of typical configuration is located on the cushion 26 at the wide end 24, the pillow 34 being scalloped for cradling the user's head N for increased user C comfort.

Figure 2:
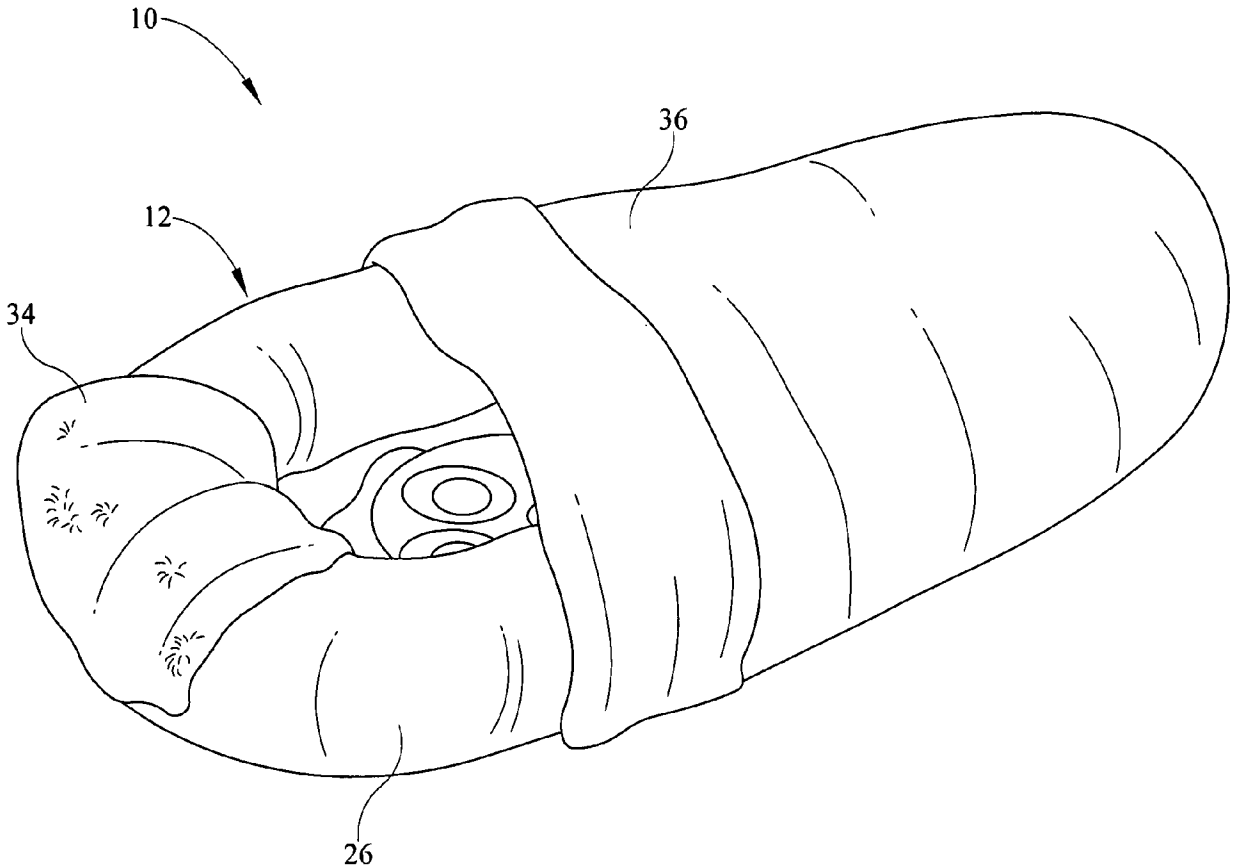
FIG. 2 is a perspective view of the sleep mat with encompassing cushion with an additional blanket removably or fixedly attached thereto.
Figure 3:
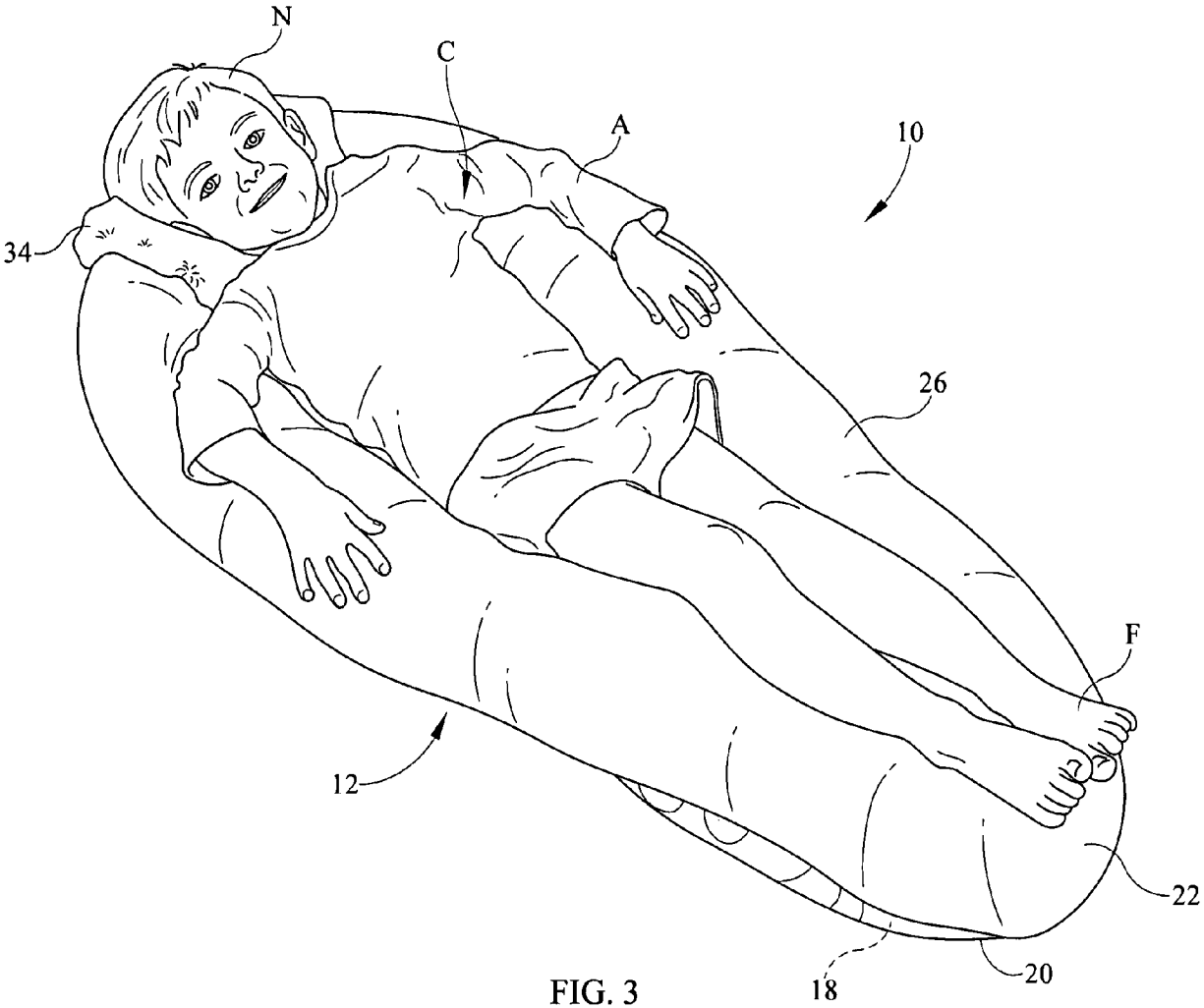
FIG. 3 is a perspective view of the sleep mat with encompassing cushion being used by a child with the child's legs resting atop the cushion.
Figure 4:
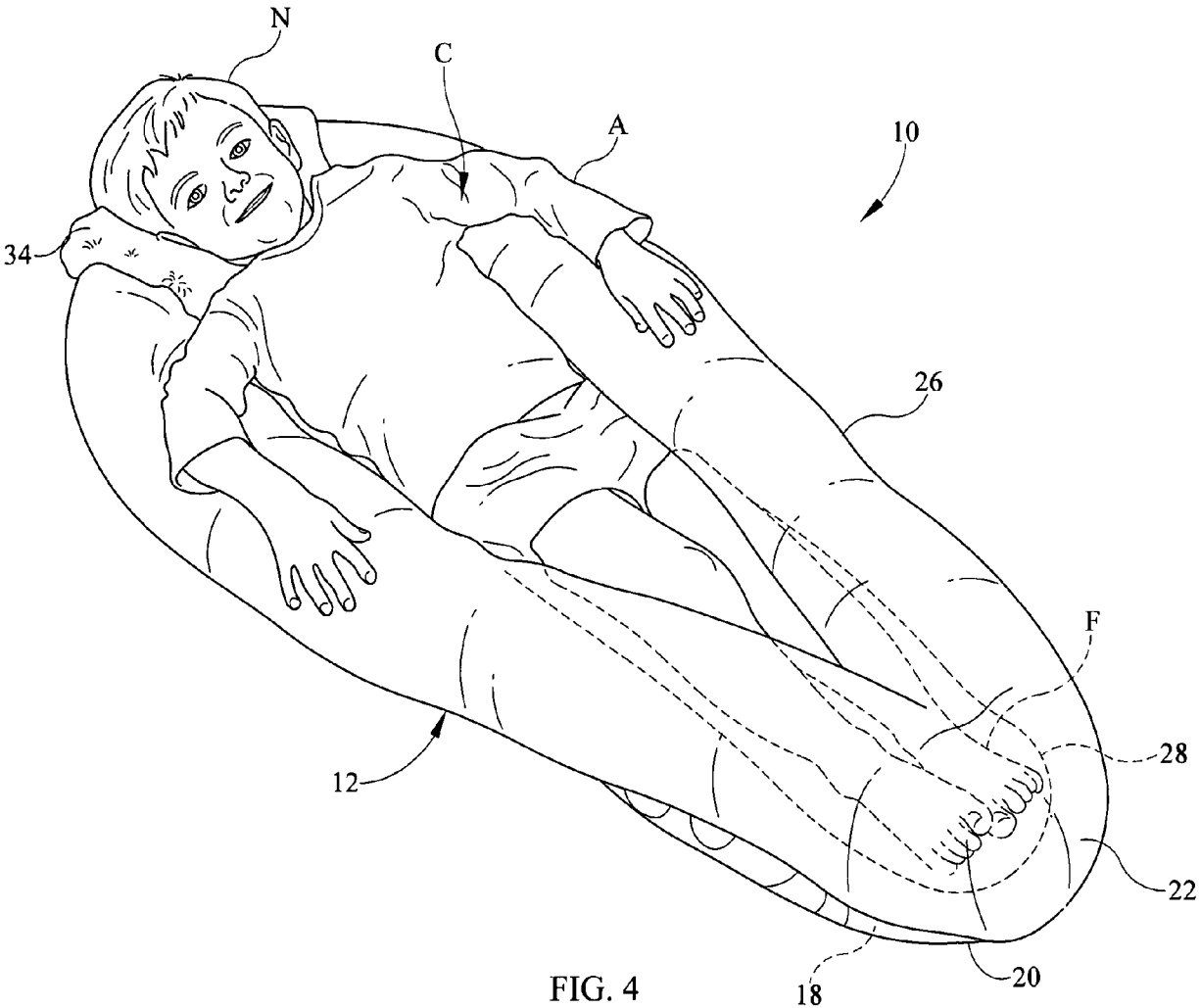
FIG. 4 is a perspective view of the sleep mat with encompassing cushion with the child's feet received within the pocket formed by the mat and the cushion proximate the narrow end of the body member.
Figure 5:
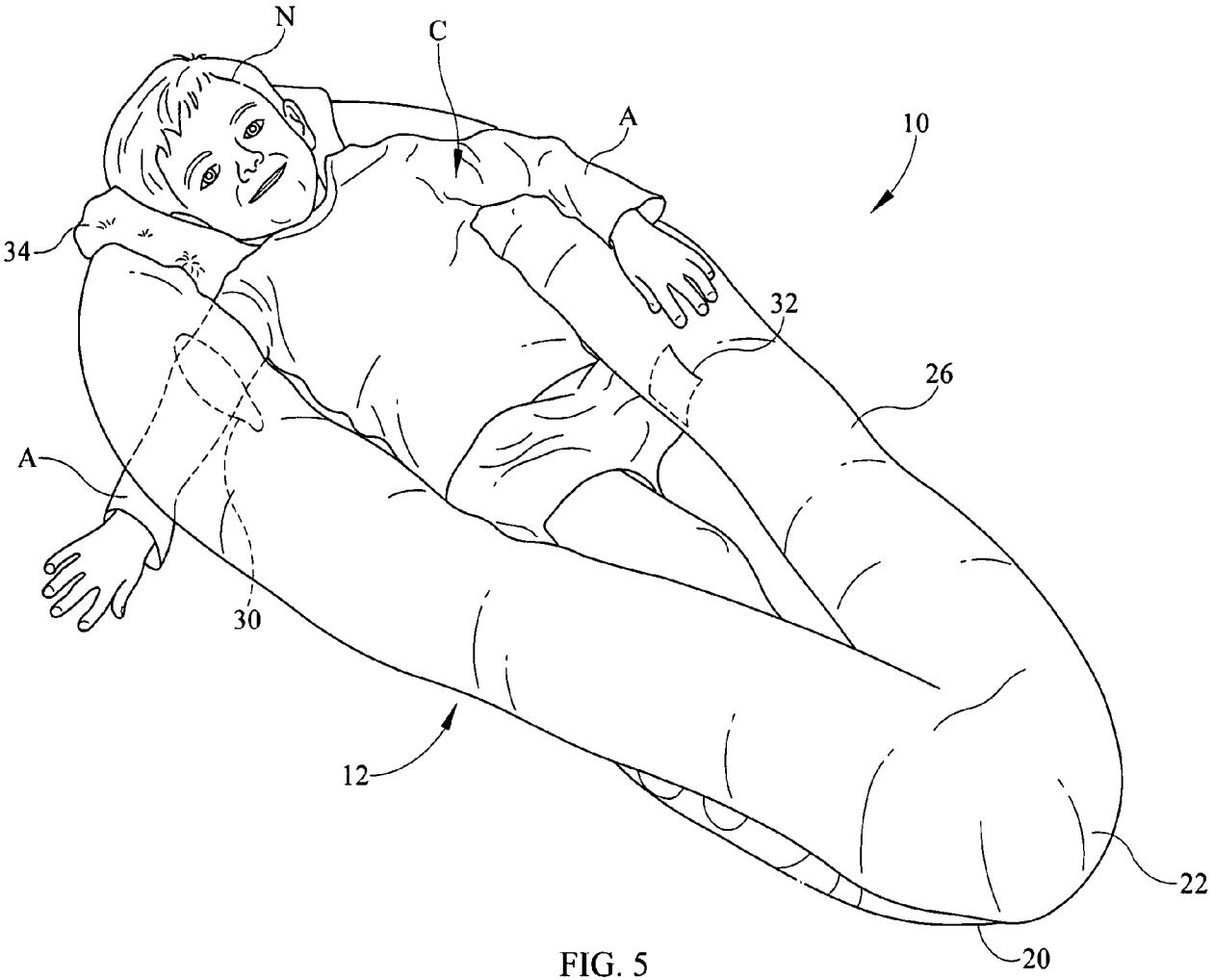
FIG. 5 is a perspective view of the sleep mat with encompassing cushion with the child's arm passing through one of the arm openings.

As seen in FIG. 2, a blanket 36 can be used with the device 10 in order to keep the occupant C warm, such that the blanket 36 may be removably attached to an appropriate spot on the body member 12 via an appropriate method such as cooperating hook and loop material, snaps, zipper, etc., or simply by slipping the blanket 36 over the narrow end 20 of the body member 12. Alternately, the blanket 36 can be fixedly attached to the body member 12 in any conventional fashion such as via stitching.

The blanket 36 can be insulated as desired for the expected conditions. For example, if the device 10 is to be used indoors, then the blanket 36 can be essentially a thin non-insulated blanket layer. However, if outdoor use of the device 10 is desired, such as in a tent, then the blanket 36 can be appropriately insulated for the expected conditions (the mat 14 and the cushion 26 being similarly insulated).

Figure 6:
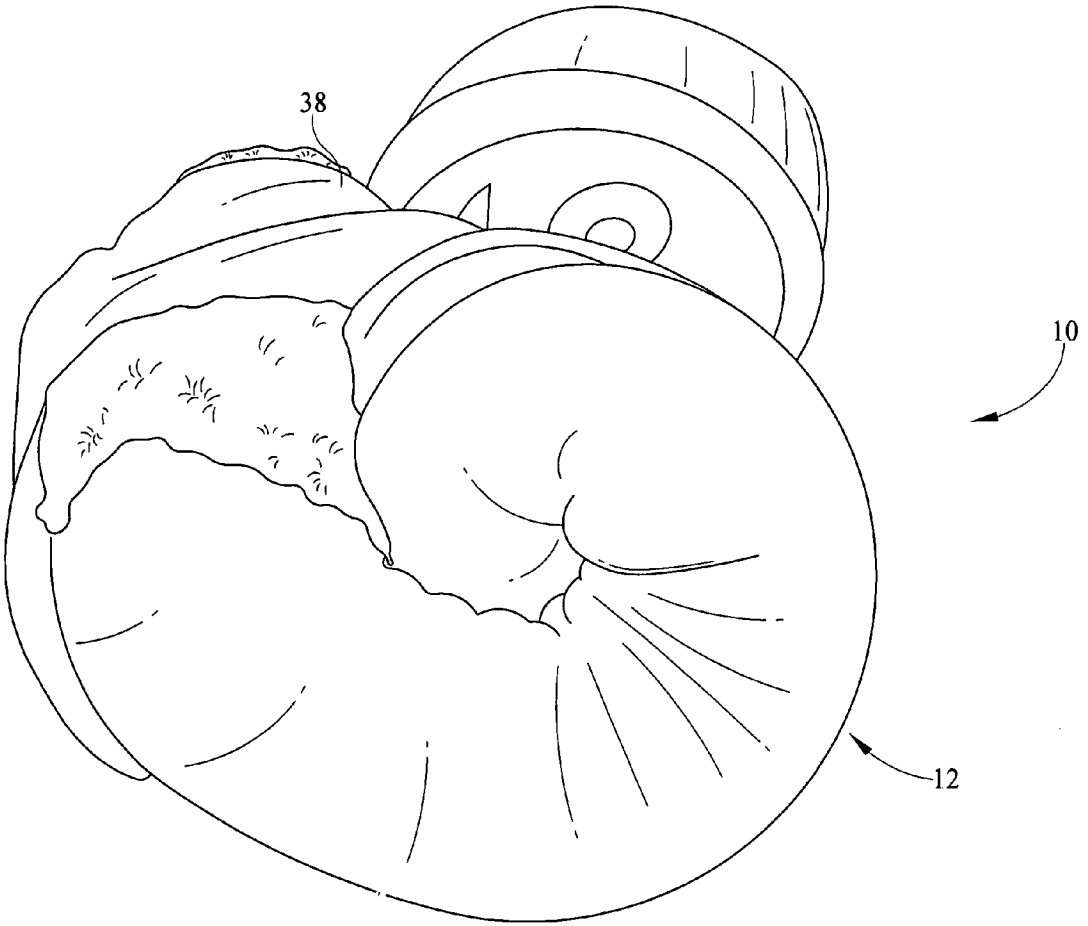
FIG. 6 is a perspective view of the sleep mat with encompassing cushion received within a detachable cover.

As seen in FIG. 6, a carrying pouch 38 can be removably attached to the body member 12 for quick and easy storage and transport of the overall device 10.

Figure 7:
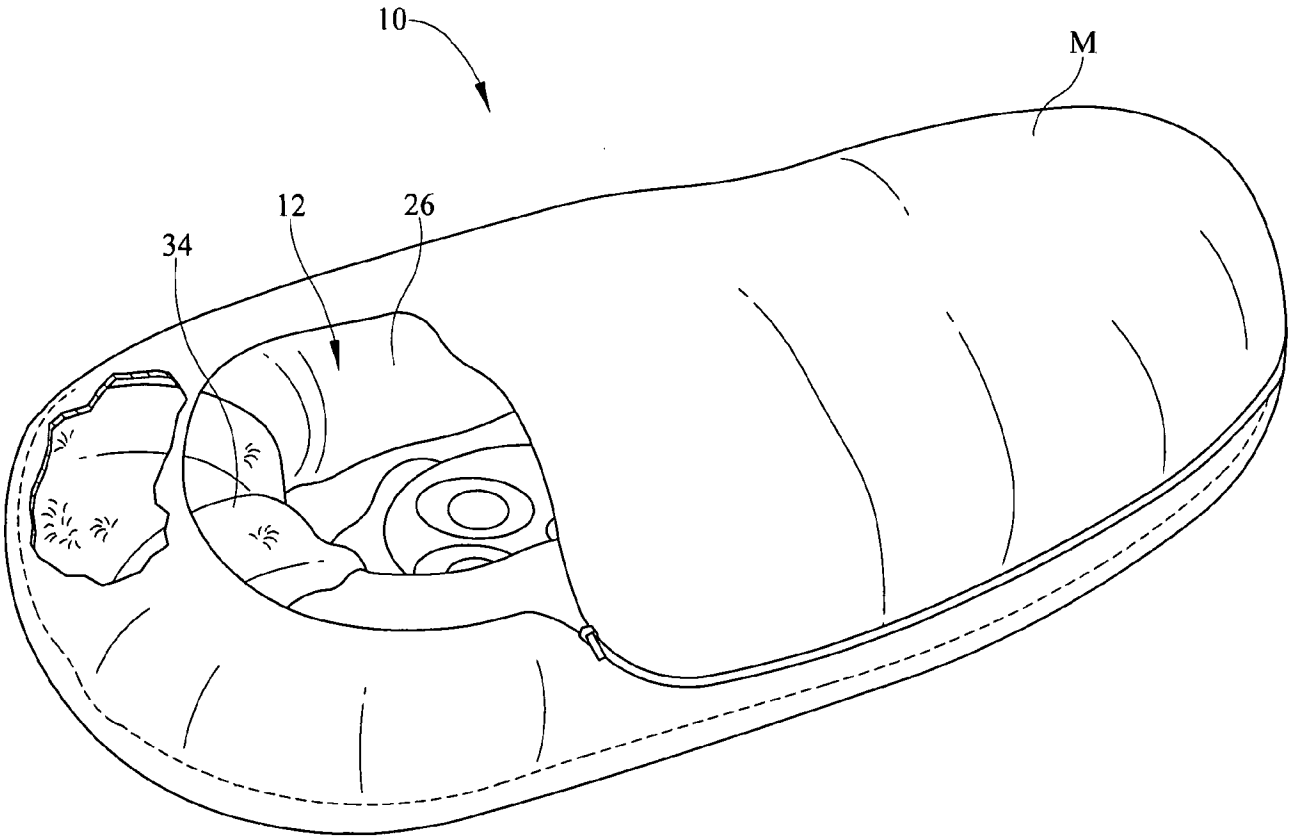
FIG. 7 is a perspective view of the sleep mat with encompassing cushion inserted within a mummy sleeping bag.

As seen in FIG. 7, the body member 12 can be an insert in a typical mummy sleeping bag M wherein the sleeping bag M encompasses the body member 12. Of course, the body member 12 can be used as an insert within a standard sleeping bag (not illustrated) as well.

The body member 12 can come in various sizes from infant to adult so that the device 10 is usable by persons of all ages.

In order to use the sleep mat with encompassing cushion 10 of the present invention, the user C is positioned within the body member 12 bounded by the cushion 26. The cushion 26 keeps the person C snug and secure and helps prevent the person C from rolling off of the mat 14, which is especially important for smaller children C. The cushion 26 also givers sleepers C using the device 10 both leg and arm support so that the user C can prop his or her arms or legs onto the cushion 26 for the support. The pear or tear drop shape adds to the snugness and security afforded by the device 10. The person C can tuck his or her lower legs and feet into the pocket 28 at the body's narrow end 22 if desired adding to the snug and secure feeling of the device 10. The person C can also tuck his or her hands and arms A into the pocket 26 proximate the pillow 34 or can tuck desired body parts into the pocket 28 at any desired portion of the pocket 28. As the pocket 28 runs the entire length of the cushion 26, the pocket 28 is highly versatile in accommodating various usage positions of the device 10 in order to give the user C a snug feeling. The person C can place on or both hands through one or both of the openings 30 as desired (side sleepers). The person C places his or her head N onto the pillow 32. As the pillow 34 is fixed, it does not change positions during use, the person C tends to sleep better due to the pillow's constant location. If desired, various items can be stored by the person C within the one or more pockets 32 provided. If a blanket 36 is used, then the blanket 36 is drawn as desired. Additionally, the device 10 can be used in a variety of locations including recreational gaming, simple lounging, book reading, and as a hammock topper. The device 10 can also be used as a simple sitting mat such or as a conventional blanket to keep warm such as when sitting on a couch watching TV.

While the invention has been particularly shown and described with reference to an embodiment thereof, it will be appreciated by those skilled in the art that various changes in form and detail may be made without departing from the spirit and scope of the invention.

We claim:

1. A method of supporting a person in a reclining position, comprising the steps of:

(a) providing a pear-shaped support having a wide end and a narrow end, the support having (i) a mat having an upper surface, a lower surface and an outer periphery, and (ii) a cushion extending upwardly from the upper surface of the mat and encompassing the outer periphery of the mat, the cushion having a downward facing surface, whereby a pocket is created at the narrow end of the support between the upper surface of the mat and the downward facing surface of the cushion, and the pocket is sized to receive the person's feet; and (b) lying in the support and inserting the feet of the person into the pocket and under the downward facing surface of the cushion.

2. The method of claim 1, whereby the person's head rests on the cushion, adjacent the wide end of the support.

3. The method of claim 1, wherein the support further comprises an opening extending from an interior of the support to an exterior of the support.

4. The method of claim 3, wherein the opening is between the mat and the cushion.

5. The method of claim 1, wherein the support further comprises first and second openings, each opening extending from an interior of the support to an exterior of the support, wherein the first and second openings are positioned to allow the person's arms to pass through the support.

6. The method of claim 1, further comprising a pillow attached to the support, adjacent the wide end of the support.

7. The method of claim 6, wherein the pillow is attached to the cushion, adjacent the wide end of the support.

8. The method of claim 1, further comprising a blanket attached to the cushion and overlaying the upper surface of the mat.

9. The method of claim 1, wherein the support is inserted inside a sleeping bag.

10. A method of supporting a person in a reclining position, comprising the steps of:

(c) providing a pear-shaped support having a wide end and a narrow end, the support having (i) a mat having an upper surface, a lower surface and an outer periphery, and (ii) a cushion extending upwardly from the upper surface of the mat and encompassing the outer periphery of the mat, wherein the cushion has inwardly facing portions adjacent the narrow end of the support, and the inwardly facing portions of the cushion are attached to one another to define a pocket sized to receive the person's feet between the upper surface of the mat and the cushion; and (d) lying in the support and inserting the feet of the person into the pocket.

11. The method of claim 10, whereby the person's head rests on the cushion, adjacent the wide end of the support.

12. The method of claim 10, wherein the support further comprises an opening extending from an interior of the support to an exterior of the support.

13. The method of claim 12, wherein the opening is between the mat and the cushion.

14. The method of claim 10, wherein the support further comprises first and second openings, each opening extending from an interior of the support to an exterior of the support, wherein the first and second openings are positioned to allow the person's arms to pass through the support.

15. The method of claim 10, further comprising a pillow attached to the support, adjacent the wide end of the support.

16. The method of claim 15, wherein the pillow is attached to the cushion, adjacent the wide end of the support.

17. The method of claim 10, further comprising a blanket attached to the cushion and overlaying the upper surface of the mat.

18. The method of claim 10, wherein the support is inserted inside a sleeping bag.

* * * * *